US010716351B2

(12) United States Patent
Meade

(10) Patent No.: US 10,716,351 B2
(45) Date of Patent: Jul. 21, 2020

(54) ZERO IMPACT HEAD GEAR

(71) Applicant: Peter G. Meade, Williston Park, NY (US)

(72) Inventor: Peter G. Meade, Williston Park, NY (US)

( * ) Notice: Subject to any disclaimer, the term of this patent is extended or adjusted under 35 U.S.C. 154(b) by 0 days.

(21) Appl. No.: 15/636,637

(22) Filed: Jun. 28, 2017

(65) Prior Publication Data

US 2017/0367427 A1 Dec. 28, 2017

Related U.S. Application Data

(60) Provisional application No. 62/355,811, filed on Jun. 28, 2016.

(51) Int. Cl.

| | |
|---|---|
| ***A42B 3/06*** | (2006.01) |
| ***A42B 3/04*** | (2006.01) |
| ***A63B 71/12*** | (2006.01) |
| ***A42B 3/20*** | (2006.01) |
| ***A42B 3/12*** | (2006.01) |

(52) U.S. Cl.

CPC ..... *A42B 3/064* (2013.01); *A42B 3/0473* (2013.01); *A42B 3/127* (2013.01); *A42B 3/20* (2013.01); *A63B 71/12* (2013.01)

(58) Field of Classification Search

CPC ..... A42B 3/064; A42B 3/06; A42B 3/063

USPC ..... 2/410, 411, 6.8

See application file for complete search history.

(56) References Cited

U.S. PATENT DOCUMENTS 3,242,500 A * 3/1966 Derr ..... A42B 3/063 2/412
3,479,666 A * 11/1969 Webb ..... A42B 3/06 2/6.6
3,616,463 A * 11/1971 Theodore et al. ..... A42B 3/063 2/412
3,879,761 A * 4/1975 Bothwell ..... A42B 3/0473 2/415
4,012,794 A * 3/1977 Nomiyama ..... A42B 3/064 2/411
4,271,537 A * 6/1981 Bowlus ..... A42B 3/20 2/424
4,307,471 A * 12/1981 Lovell ..... A42B 3/065 2/411
4,345,338 A * 8/1982 Frieder, Jr. ..... A42C 2/007 2/414
4,432,099 A * 2/1984 Grick ..... A42B 3/124 2/412

(Continued)

OTHER PUBLICATIONS

Mark Wilson, Why NFL Helmets Will Never Be Concussion-Proof, www.fastcompany.com/1671752/why-nfl-helmets-will-never-be-concussion-proof, Jan. 5, 2016, 8 pgs.

(Continued)

*Primary Examiner* — Heather N Mangine

(74) *Attorney, Agent, or Firm* — Christopher R. Balzan, Esq.

(57) ABSTRACT

In one embodiment, a zero impact head gear is provided including an outer helmet and an inner helmet. The outer helmet has forward and rear retaining stops protruding from the interior of the outer helmet. The inner helmet has a forward and rear retaining stops protruding from the inner helmet to allow movement of the inner helmet within the outer helmet, but capable of limiting a forward displacement the inner helmet with respect to the outer helmet.

22 Claims, 8 Drawing Sheets

(56) References Cited

U.S. PATENT DOCUMENTS 5,123,408 A * 6/1992 Gaines ..... A42B 3/0473 2/425
5,204,998 A * 4/1993 Liu ..... F16F 1/3732 2/411
5,493,736 A * 2/1996 Allison ..... A42B 3/0473 2/411
5,581,816 A * 12/1996 Davis ..... A42B 3/0473 2/410
5,742,937 A * 4/1998 Baudou ..... A42B 3/042 2/411
6,006,368 A * 12/1999 Phillips ..... A42B 3/0473 2/421
6,282,724 B1 * 9/2001 Abraham ..... A41D 13/015 2/267
6,324,700 B1 * 12/2001 McDougall ..... A42B 3/324 2/414
6,385,781 B1 * 5/2002 Rose ..... A42B 3/00 2/421
6,658,671 B1 * 12/2003 Von Holst ..... A42B 3/064 2/412
6,968,576 B2 11/2005 McNeil et al.
7,328,462 B1 * 2/2008 Straus ..... A42B 3/067 2/411
7,930,771 B2 * 4/2011 Depreitere ..... A42B 3/064 2/411
8,069,498 B2 * 12/2011 Maddux ..... A42B 3/124 2/414
8,296,863 B2 * 10/2012 Cripton ..... A42B 3/064 2/411
8,621,672 B2 * 1/2014 Chuback ..... A41D 13/0512 2/421
8,656,520 B2 * 2/2014 Rush, III ..... A42B 3/20 2/422
9,173,445 B1 * 11/2015 Whitcomb ..... A42B 3/124
9,179,727 B2 * 11/2015 Grant ..... A42B 3/064
9,332,799 B1 * 5/2016 Wenner ..... A42B 3/064
9,462,841 B1 * 10/2016 Popejoy ..... A41D 13/0512
9,750,297 B1 * 9/2017 Mini Townson ..... A42B 3/14
9,975,032 B2 * 5/2018 Frey ..... A63B 71/10
9,987,544 B2 * 6/2018 Sodec, Jr. ..... A63B 71/10
10,010,126 B1 * 7/2018 Shaffer ..... A42B 3/064
2004/0117896 A1 * 6/2004 Madey ..... A42B 3/064 2/411
2004/0194194 A1 * 10/2004 McNeil ..... A42B 3/0473 2/421
2004/0250340 A1 * 12/2004 Piper ..... A42B 3/064 2/411
2004/0261157 A1 * 12/2004 Talluri ..... A42B 3/063 2/412
2006/0059606 A1 * 3/2006 Ferrara ..... A01N 25/18 2/412
2012/0186002 A1 * 7/2012 Bhatnagar ..... A42B 3/063 2/412
2012/0198604 A1 * 8/2012 Weber ..... A42B 3/125 2/414
2012/0204327 A1 * 8/2012 Faden ..... A42B 3/063 2/411
2012/0233745 A1 * 9/2012 Veazie ..... A42B 3/121 2/413
2013/0042397 A1 * 2/2013 Halldin ..... A42B 3/064 2/411
2013/0061371 A1 * 3/2013 Phipps ..... A42B 3/064 2/411
2013/0219595 A1 * 8/2013 Musal ..... A42B 3/205 2/414
2014/0013491 A1 * 1/2014 Hoshizaki ..... A42B 3/12 2/411
2014/0013492 A1 * 1/2014 Bottlang ..... A42B 3/125 2/414
2014/0023805 A1 * 1/2014 Greenhill ..... F41H 1/04 428/34.1
2014/0090155 A1 * 4/2014 Johnston ..... A42B 3/064 2/414
2014/0259313 A1 * 9/2014 Sullivan ..... A42B 3/121 2/413
2015/0074875 A1 * 3/2015 Schimpf ..... A42B 3/064 2/411
2015/0089722 A1 * 4/2015 Berry ..... A42B 3/064 2/412
2015/0101093 A1 * 4/2015 Occhipinti ..... A42B 3/125 2/2.5
2015/0113718 A1 * 4/2015 Bayer ..... A41D 13/0512 2/461
2015/0135413 A1 * 5/2015 Mayerovitch ..... A42B 3/125 2/414
2015/0157083 A1 * 6/2015 Lowe ..... A42B 3/064 2/412
2015/0223543 A1 * 8/2015 Hernandez ..... A42B 3/0473 2/459
2015/0305427 A1 * 10/2015 Prabhu ..... A42B 3/128 2/412
2015/0313305 A1 * 11/2015 Daetwyler ..... A42B 3/285 2/414
2016/0037850 A1 * 2/2016 Benson ..... A42B 3/0473 2/411
2016/0108194 A1 * 4/2016 Topolkaraev ..... C08L 67/04 428/76
2016/0157543 A1 * 6/2016 Huang ..... A42B 3/0473 2/411
2016/0316847 A1 * 11/2016 Weber ..... A42B 3/125
2016/0360818 A1 * 12/2016 Riina ..... A42B 3/064
2017/0065017 A1 * 3/2017 Janson ..... A42B 3/127
2017/0105470 A1 * 4/2017 Eaton ..... A42B 3/064
2017/0127748 A1 * 5/2017 Sethumadhavan .... A42B 3/063
2017/0150767 A1 * 6/2017 Wetzel ..... A63B 71/10
2017/0164678 A1 * 6/2017 Allen ..... A42B 3/061
2017/0280814 A1 * 10/2017 Tuttle ..... A42B 3/08
2017/0290388 A1 * 10/2017 Briggs ..... A42B 3/064
2017/0367427 A1 * 12/2017 Meade ..... A42B 3/0473
2017/0367428 A1 * 12/2017 Bayer ..... A42B 3/14
2018/0184743 A1 * 7/2018 Jeong ..... A42B 3/063
2018/0192728 A1 * 7/2018 Cleveland ..... A42B 3/128
2018/0317589 A1 * 11/2018 Mestas ..... A42B 3/121
2018/0338558 A1 * 11/2018 Reynolds ..... A42B 3/064
2018/0360153 A1 * 12/2018 Popejoy ..... A41D 13/0512
2019/0029352 A1 * 1/2019 Sadegh ..... A42B 3/06

OTHER PUBLICATIONS

Rolland S. Parker, Concussive Brain Trauma: Neurobehavioral Impairment and Maladaptation, p. 84, CRC Press, Dec. 27, 2000, 1st Ed., CRC Press, Boca Raton, FL.

* cited by examiner

ZERO IMPACT HEAD GEAR

CROSS-REFERENCE

The present application claims the benefit of U.S. Provisional Application Ser. No. 62/355,811, entitled ZERO IMPACT HEAD GEAR, by Peter G. Meade, filed Jun. 28, 2016, herein incorporated by reference in its entirety.

BACKGROUND

In many contact sports, as well as other activities where there is a potential for head impact, helmets or other head gear are worn to protect the head from injuries. Although current helmets do protect from some head injuries, many head injuries such as concussions, unfortunately still occur with surprising frequency. Furthermore, current helmet and head gear do not sufficiently protect the wearer from neck injuries.

As such there is a need for an improved helmet or head gear and other activities where head and neck injury is prevalent.

SUMMARY

In one embodiment, a zero impact head gear including an outer helmet and an inner helmet. The outer helmet has an energy absorbing outer shell, a rigid shell, and an energy absorbing inner liner. The inner helmet is formed of an energy absorbing material and is sized relative to the outer helmet so as to provide a gap between an outer surface of the inner helmet and an inner surface of the inner liner when worn on by an individual. A forward retaining stop and a rear retaining stop protrude from the inner liner. A forward halo stop and a rear halo stop protruding from the inner helmet. The forward retaining stop and the forward halo stop are positioned so as to allow movement of a head of the individual within the outer helmet and capable of engaging each other to limit a forward displacement of the head of the individual out of the helmet. Similarly, the rear retaining stop and the rear halo stop are positioned so as to allow movement of the head of the individual within the outer helmet and capable of engaging each other to limit a forward displacement of the head of the individual out of the helmet.

DESCRIPTION

Figure 1:
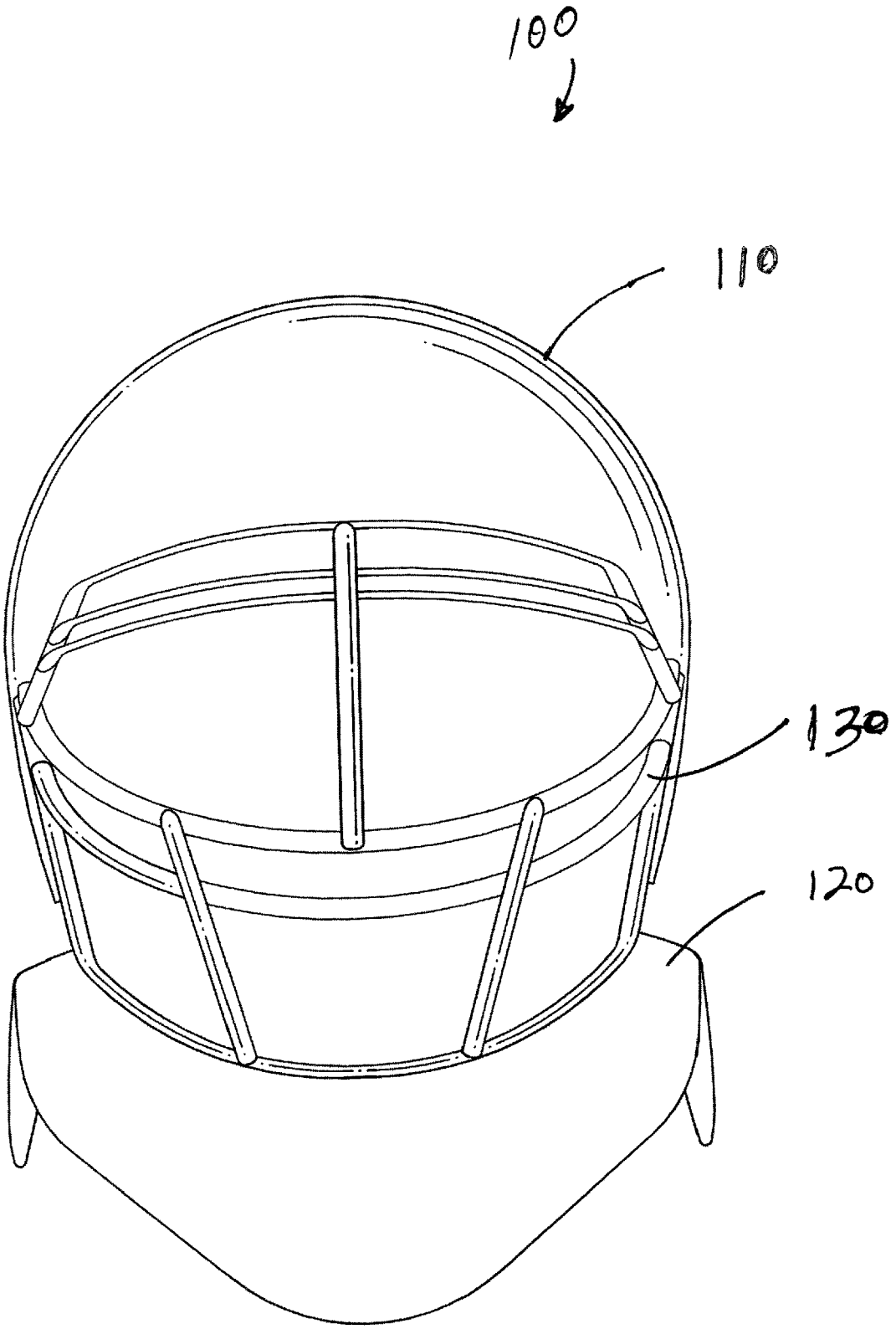
FIG. 1 shows a front view of an embodiment of a zero impact head gear.

FIG. 1 shows a front view of an embodiment of a zero impact head gear 100. The zero impact head gear is a safety device worn over the head and securely anchored to shoulder pads (not shown in FIG. 1). It greatly reduces, or even eliminates, direct impact to the head when an outside force is applied to the device 100. Thus, it reduces the probability of injuries associated with a direct impact to the head. As such, it is extremely beneficial during contact sports, or other sports or activities where contact to the head are possible.

The zero impact head gear 100 has an outer helmet 110 and an inner helmet portion (not shown in FIG. 1). The outer helmet 110 has a neck portion 120, which extends to allow the outer helmet to fit securely with a shoulder portions, such as shoulder pads (not shown in FIG. 1).

The zero impact head gear 100 typically has an optional face mask or cage 130. The cage 130 may be affixed to the outer helmet 110, such as for example, it may be screwed, clipped, strapped, bonded, secured by hook and loop (VELCRO™), or the like. In some embodiments, the cage 130 may be formed integrally with, or even formed into the outer helmet 110.

Figure 2:
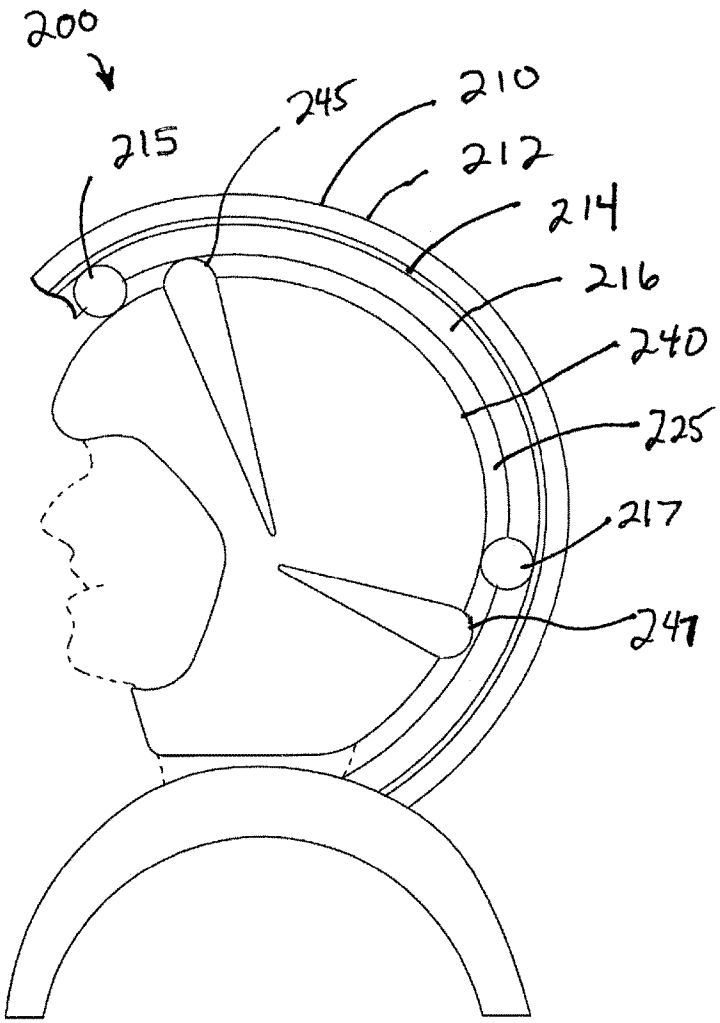
FIG. 2 shows a partial cut away side view of an embodiment of the zero impact head gear.

FIG. 2 shows a partial cut away side view of an embodiment of the zero impact head gear 200. The outer helmet 210 may have impact absorbing outer shell 212 over a rigid shell 214. Inside the rigid shell 214 may be an impact absorbing material inner liner 216. Additional shells, liners, or layers may be present in other embodiments. The inner liner 216 may be removably secured to the rigid shell so that it is easily replaceable if damaged. Thus, the inner liner 216 (which may include the retaining stops 215 and 217, integrally formed or separately inserted) may be a consumable, which is replace periodically. Similarly, the outer shell 212 may also be removably secured to the rigid shell 214 so that it is easily replaceable if damaged, or for convenience or aesthetic purposes.

The zero impact head gear 200 also has an inner helmet 240 is secured to the player's head. Between the inner helmet 240 and the outer helmet 220 is space 225 that acts as a buffer zone between the inner helmet 220 and the outer helmet 210. This creates a zone 225 that allows some degree of movement of the player's head within the outer helmet 220. The space 225 may be for example, one inch or more between the inner lining 216 and the inner helmet 240 to allow free rotational movement of the head within the outer helmet 210.

To keep the player's head from extending too far forward out of the outer helmet 210, forward and rear retaining stops 215 and 217, inside the outer helmet 210. The forward and rear stops 215 and 217 work in concert with front and rear halo stops 245 and 247, respectively, to limit the motion of the player's head in a forward direction out of the outer helmet 210, while allowing a certain degree of forward movement, as well as side to side and rotational movement. Thus, the player's head is relatively free to move within the outer helmet 210, but, is limited by coordinating forward stops 215 and 245, and rear stops 217 and 247, in how far it can extend forward out of the outer helmet 210. Ideally, the stops 215, 245, 217, and 247 keep the player's face from contacting the front of the cage 130 (FIG. 1), if used.

The forward and rear retaining stops 215 and 217 may be partially or completely cylindrical, spherical, rectilinear, or other configuration or combinations of such. For example, the forward retaining stop 215 may be an arcuate cylindrical bar insert or an arcuate semi-cylindrical bump, while the rear retaining stop 217 may be the same or may be a spherical insert or semispherical protrusion. In some embodiments, the forward retaining stop 215 may be a foam insert, or it be molded as part of a foam inner liner 216.

Similarly, the front and rear halo stops 245 and 247 may be partially or completely cylindrical, spherical, rectilinear, or other configuration, such as conical (as shown in FIG. 2), or combinations of such. For example, the forward halo stop 245 may be an elongated arcuate conical bar insert, or an elongated arcuate semi-conical bump, extending from a first terminal end located on a left half of the inner helmet to a second terminal end located on a right half of the inner helmet, while the rear retaining stop 247 may be the same (as shown in FIG. 2). In some embodiments, the forward and rear halo stops 245 and 247 may be foam or other material inserts, or it be molded as part of a foam or similar material inner helmet 240, and may be smaller or larger than shown depending on the outer helmet configuration.

In yet another embodiment, the forward and rear halo stops 245 and 247 may have a single torroidal or donut configuration (not shown), extending completely around the inner helmet 240. Alternatively, the forward and rear retaining stops 215 and 217 may have a single torroidal configuration (not shown), extending completely around the inner liner 216 of the outer helmet 210.

Figure 12:
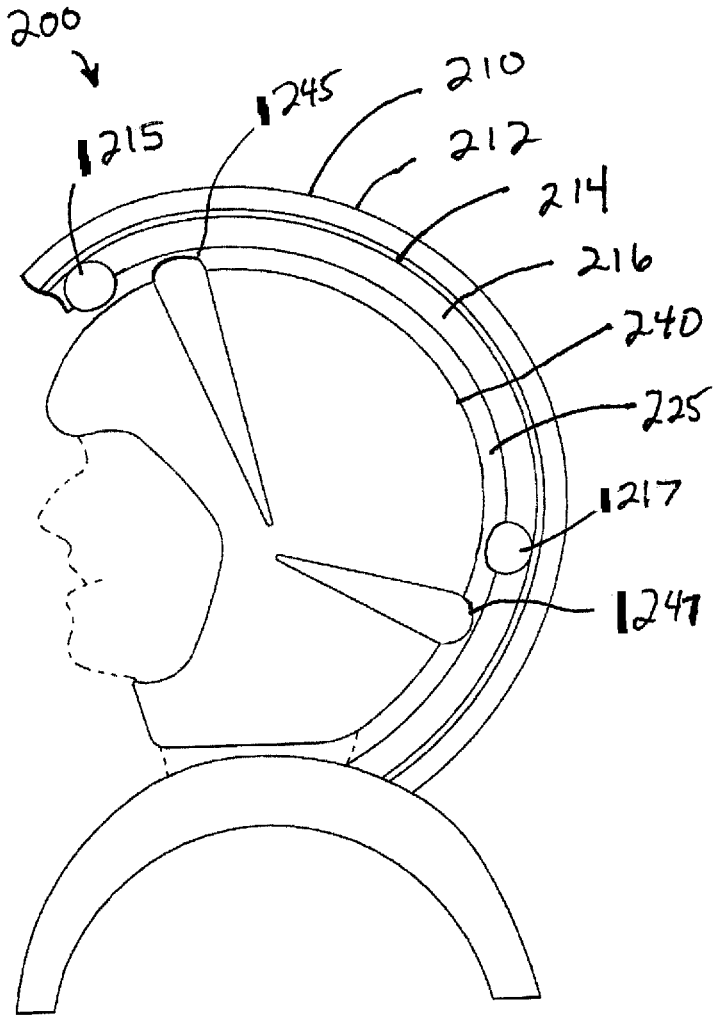
FIG. 12 shows a partial cut away side view of a possible alternate embodiment of the zero impact head gear.

Although shown touching the inner liner 216, the forward and rear halo stops 245 and 247 may sized smaller so that they do not touch the inner lining 216 but long enough to contact the front and rear retaining stops 215 and 217, as shown in FIG. 12 by the forward and rear halo stops 1245 and 1247. Likewise the front and rear retaining stops 215 and 217 may sized smaller so that they do not touch the inner helmet 240 but long enough to contact the forward and rear halo stops 245 and 247 when the head extends forward, as shown in FIG. 12 by the front and rear retaining stops 1215 and 1217. Also, the distance between the forward retaining stop 215 and forward halo stop 245, and the distance between the rear retaining stop 217 and rear halo stop 247, are set to allow some degree of forward displacement of a player's head while keeping the head from extending so far out of the outer helmet 210 that it potentially cause injury to the player.

Figure 3:
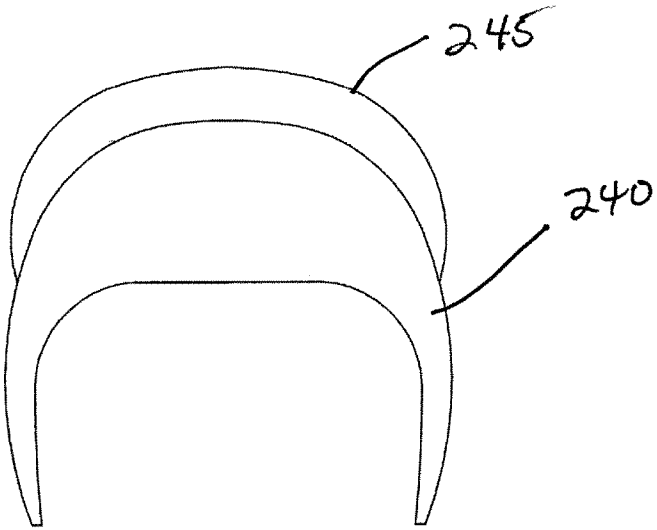
FIG. 3 is a front view of an embodiment of the inner helmet showing the front halo stop.

FIG. 3 is a front view of an embodiment of the inner helmet 240 showing the front halo stop 245. In this embodiment a separate chin strap (not shown) may be used to secure the inner helmet 240 to the player's head.

An advantage of some embodiments is as the head is thrown forward, the two halo stops 245 and 247 will contact the two retaining stops 215 and 217, respectively, to limit the downward movement of the head and prevent, or greatly reduce, neck injury during an impact.

The halo stops 245 and/or 247 need not be a true "halo" configuration or arrangement, but may be separate bars or bumps sufficient to engage the retaining stops 215 and/or 245, depending on the retaining stop 215 and/or 245 configuration or arrangement.

Figure 4:
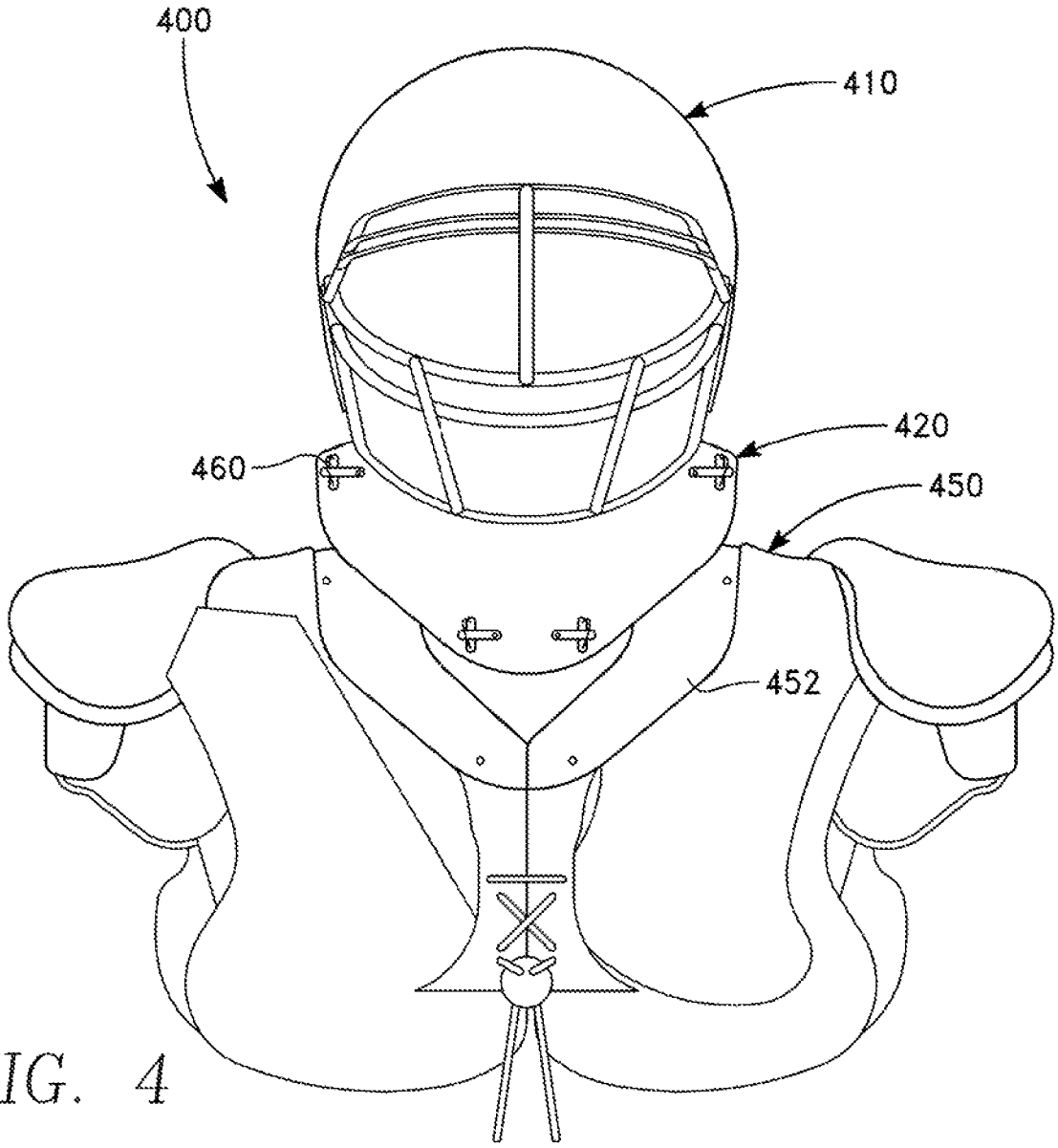
FIG. 4 shows an embodiment of a front view of the zero impact head gear with shoulder pads.

FIG. 4 shows an embodiment of a front view of the zero impact head gear 400 with shoulder pads 450. The zero impact head gear 400 secured to the shoulder pads 450 using lacing, snaps, hook and loop, or bolts 460. In some embodiments, the outer helmet 410 is securely mounted to the shoulder pads 450 with a "J" bolt 560 (shown in FIGS. 5A & 5B). The neck portion 420 of the outer helmet 410 may fit into a recess 452 in the shoulder pads 450.

Figure 6:
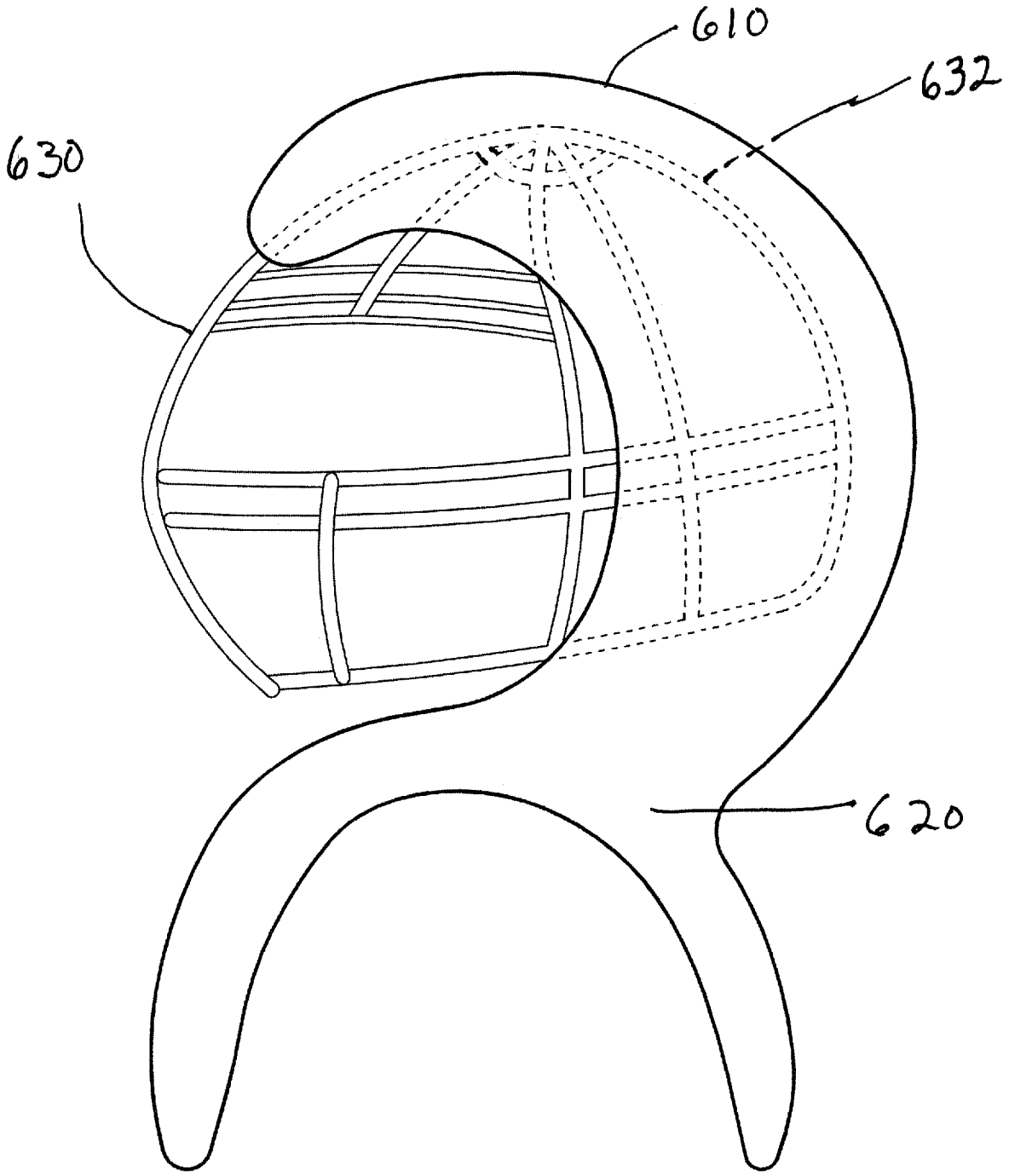
FIG. 6 shows a side view of an embodiment having a cage.

FIG. 6 shows a side view of an embodiment having a cage 630 which could extend in front of a player's or individual's face. In this embodiment, the cage 630 extends all the way around the outer helmet 610. With this embodiment, it is possible to form a single "bird cage" configuration 632 surrounding the head to add support and further protect the player from front facial impact by transferring the impact to the shoulder pads 450 (shown in FIG. 4) to which the outer helmet 610 is attached. FIG. 6 also illustrates how the outer helmet 610 may be integrally formed with the neck portion 620, which may further extend to over the shoulders down the nape of the neck in the back and over the collar bone and chest in the front to provide added stability. Further, the cage 630 may have a portion extending into the neck portion 620, including nape and chest portions as shown in FIG. 7.

Figure 7:
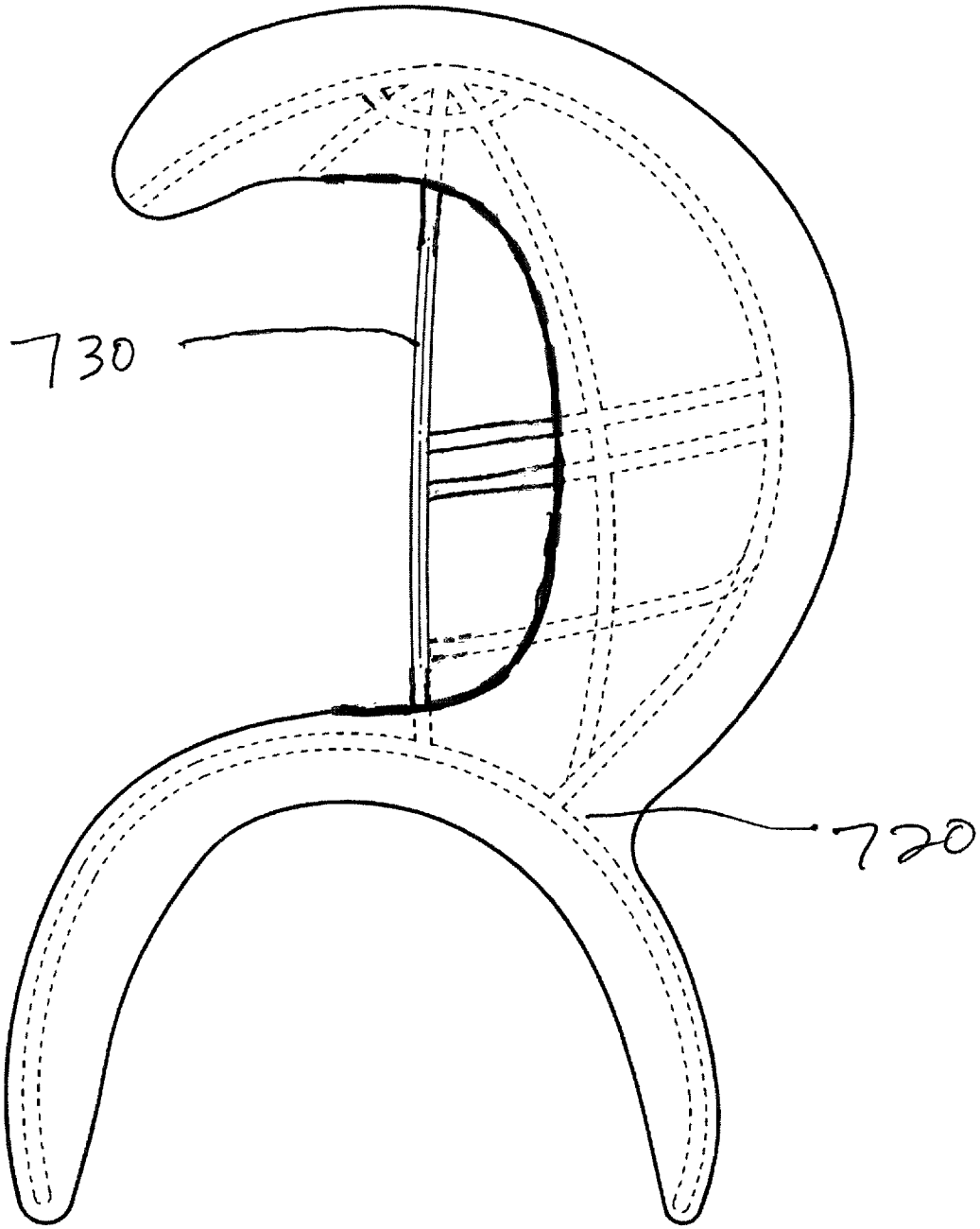
FIG. 7 shows a side view of an embodiment having a cage.

Turning to FIG. 7, shown is a side view of a possible embodiment having a partial cage 730. In this embodiment, the cage 730 provides an open face portion. Additional, in some embodiments, the cage 730 may extend into the neck portion 720, including over the shoulder/nape/chest portions to provide added strength.

Referring to FIG. 2, in various embodiments, the outer helmet 210 is larger than the player's head (and inner helmet 240), allowing for free movement of the player's head within the outer helmet 210. This creates a zero impact zone 225 around the head. If a force applied to the outer helmet 210 is too great, the energy absorbing inner helmet 240, which is worn directly on the head, will impact the energy absorbing foam inner liner 216. Furthermore, the stops 215, 217, 245, and 247 typically are formed of energy absorbing material, such as foam, to more gradually arrest the head during a severe impact. This can create an environment where the head realizes a brief acceleration, with a slowed controlled stop during an impact. Thus, for example, depending the particular embodiment and on the direction of the impact, the halo stop 247 and/or the retaining stops 245 may additionally cushion the movement of the head within and back against the outer helmet 210.

Referring to FIGS. 2, 6, and 7, one advantage is that the inner helmet 240 can provide protection over the forehead if desired, while the outer helmet 210 can be above the forehead to provide improved visibility. It is also possible to provide an extended peripheral side opening to further improve visibility.

Referring to FIGS. 2, 4, 6, and 7, an additional advantage of various embodiments is that the neck is prevented from snapping back due to the connection of the head gear 400 to the shoulder pads 450. Additionally, the head is limited from moving into a potentially dangerous position when making a tackle for example. Further, due to the space 225 and connection of the head gear 400 to the shoulder pads 450, there is no impact to the player's head since the impact is transferred to the shoulder via the shoulder pads 450.

In various embodiments, the impact absorbing outer shell 212, the absorbing material inner liner 216, and/or the inner helmet 240 can be any impact absorbing material including foam, inflatable material such as bubble, or other gas containing or inflatable modular or other gas compartmented materials, either closed or open cell. In other embodiments, other know impact or energy absorbing or energy dispersing material may be used for one or more of the outer shell 212, the absorbing material inner liner 216, and/or the inner helmet 240.

Figure 8:
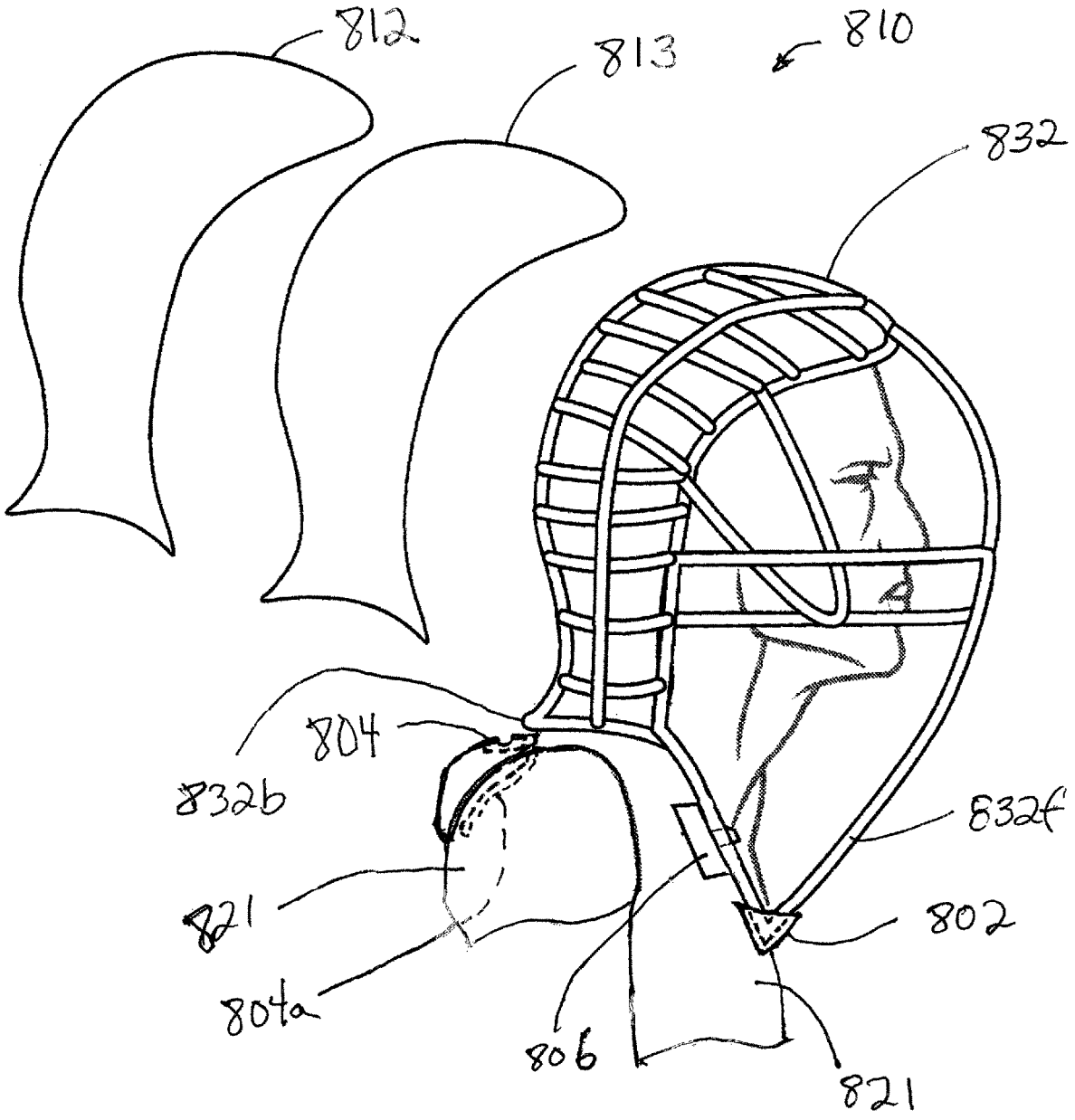
FIG. 8 is an exploded side view of another embodiment.

FIG. 8 is an exploded side view of another embodiment. FIG. 8 shows an embodiment having a cage 832 which extends all the way around the head to cover the front of the player's face. In some embodiments, the cage 832 is part of the outer helmet 210 (FIG. 2) typically instead of, or in addition to, the rigid shell 214 (FIG. 2). This embodiment may have an absorbing liner 813, such as foam, covered by an outer shell 812 of protective material, such as rubber, other deformable resilient material, or the like. In other possible embodiments, the outer shell 812 may be a plastic material.

With the embodiment shown in FIG. 8, an absorbing inner liner 216 (FIG. 2), an inner helmet 240 (FIG. 2), and optionally may include the stops 215, 217, 245, and 247 (FIG. 2). In other embodiments of FIG. 8, the outer helmet 810 may be sized to contain conventional padding to fit directly on the head of a player.

In the embodiment of FIG. 8, the cage is retained to shoulder pads 821 with a front locking bracket 802 and a rear mount 804. The front locking bracket 802 and the rear mount 804 are secured to shoulder pads 821, which may be conventional shoulder pads. In the embodiment shown, a front portion 832*f* of the cage 832 is inserted into the front locking bracket 802 and then back portion 832*b* of the cage 832 is inserted and locked into the rear mount 804. FIG. 8 is shown with the front portion 832*f* secured within the front locking bracket 802 and just prior to insertion and locking of the back portion 832*b* of the cage into the rear mount 804. Optional side alignment brackets 806 help guide the cage during its insertion into the rear mount 804.

Figure 9A:
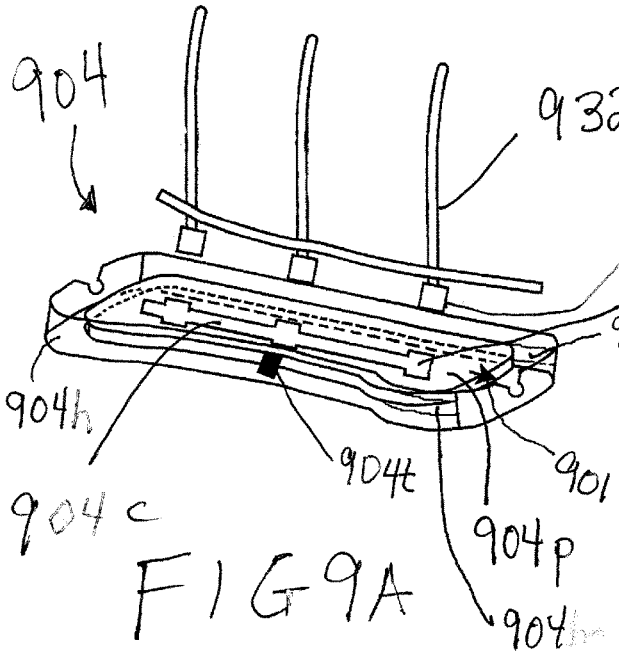
FIG. 9A shows a perspective view of a rear mount 904.
Figure 9B:
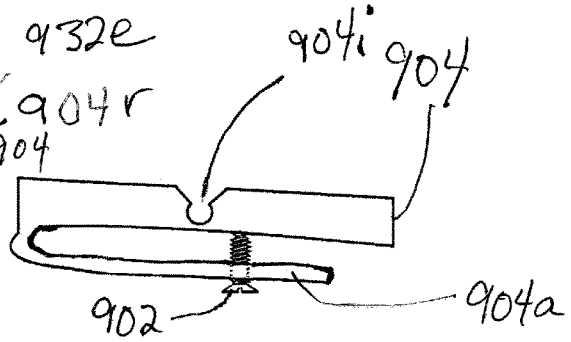
FIG. 9B shows a left side view of the rear mount 904 with additional optional retaining arm.

FIG. 9A shows a perspective view of a rear mount 904. FIG. 9B shows a left side view of the rear mount 904 with additional optional retaining arm 904*a*. In this embodiment, a locking plate 904*p* is provided so that after the back portion 932*b* of the cage 932 is inserted into the back mount 904, the locking plate 904*b* holds the back portion 932*b* of the cage 932 in place. In this embodiment, the back portion 932*b* of the cage 932 has insertion extensions 932*e* design to fit within receiver openings 932*r*. After the extensions 932*e* are lowered into the opening 932*r* the locking plate is slid, as indicated by arrow 901, so that the larger ends of the insertions extensions 932*e* are retained by the locking plate. The receiver openings 904*r* are located in a channel 904*c*, and are slightly larger in size than the channel 904*c* so that the larger ends of the insertion extensions 932*e* fit within channel 932*c* through the larger receiver openings 904*r*, but not through the narrower portions of the channel 904*c*. A tab 904*t* can be used to slide the locking plate 904*p* to lock in the cage. The locking plate slides along sidewall guide channels $\mathbf{904}g_1$ and $\mathbf{904}g_2$ in the housing.

Turning to FIGS. 8 and 9B, one or more, retaining arms 904*a*, may be used to secure the mount 904 to the shoulder pads 821. The retaining arms 804*a* extend below the shoulder pad 821 to hold the mount 804 to the shoulder pad 821. A screw or other fastening device may be used to hold the mount 804 in place with respect to the shoulder pads 821. The mount 904 optionally has top insertion guides 904*i* to position the back portion 932*b* of the cage 932 during and after insertion of the extensions 932*e*. After insertion the lowest horizontal rail of the cage 932 seats within the guides 904*i*.

In one embodiment, screws 902 are used to fasten the mount 904 and are screwed through the retaining arms 904*a*, the shoulder pad (not shown) and into the housing 904*h*. Other fastening means may be used to securely or adjustably secure the mount 904 to the shoulder pads.

Figure 5A:
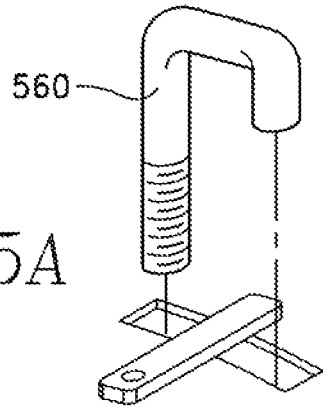
FIGS. 5A and 5B are an exploded views of FIG. 4 showing a possible means of securing the zero impact head gear with shoulder pads.
Figure 5B:
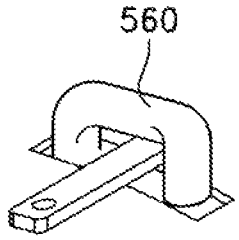
Figure 10:
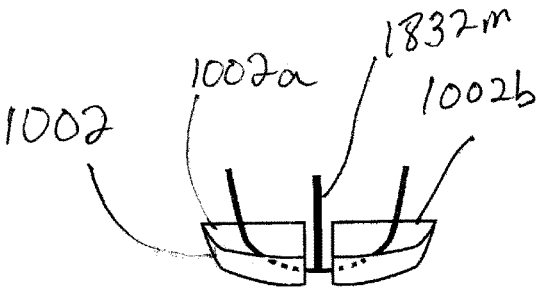
FIG. 10 is a front view of the front locking bracket with part of the front portion of the cage inserted.

Shown in FIG. 10 is a front view of the front locking bracket 802 with part of front portion 832*f* inserted. In this embodiment, the front locking bracket 1002 has two parts with an opening therebetween. Typically the chest portion of the shoulder pads have two sides laced together, as shown in FIGS. 5A & 5B. Thus, one part 1002*a* of the front locking bracket 1002 is on the right side of the shoulder pad and the other part 1002*b* on the left so that the shoulder pad may be loosened or opened while the front locking bracket 1002 is affixed or fastened to the should pads. Having a two part front locking bracket 1002 also allows the middle vertical member 1832*m* of the front cage portion to align between the parts 1002*a* and 1002*b*. Thus the front locking bracket 1002 performs both alignment and retaining functions during and after the cage is secured.

Figure 11:
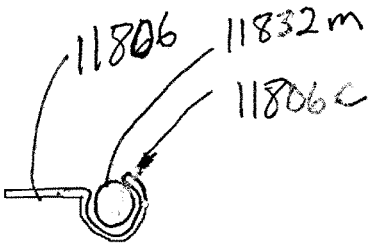
FIG. 11 shows a side view of a side alignment bracket.

FIG. 11 shows a side view of one of the side alignment brackets 11806. The side alignment brackets 11806 align the cage during and after the cage is secured. The side alignment bracket may be adjustably fastened to the shoulder pads so that they may in the correct position to provide proper alignment while the cage is being secured to the shoulder pads and after installation. Optionally, the side alignment brackets 11806 has an releasable capture mechanism which may be an extension, clip, interference fit, or the like so that the cage member 11832*m* fits releasably within the alignment bracket 11806. In the example of FIG. 11, a portion 11806*c* of the bracket 11806 extends around more than half of the circumference of the cage member 11832*m* to releasably capture the cage member 11832*m*.

Various of embodiments of the presently described and claimed invention may have application to many sports such as for example, lacrosse, football, hockey, skiing, motocross, snowmobiling, or other motorsports. In some embodiments, depending on the impact forces the materials used may be lighter and more appropriate for the expected range of impact forces. For example, in skiing embodiments, the shoulder connection may be to a vest, such as a poly-paraphenylene terephthalamide or KEVLAR® vest.

It is worthy to note that any reference to "one embodiment" or "an embodiment" means that a particular feature, structure, or characteristic described in connection with the embodiment may be included in an embodiment, if desired. The appearances of the phrase "in one embodiment" or "in an embodiment" in various places in the specification are not necessarily all referring to the same embodiment.

The illustrations and examples provided herein are for explanatory purposes and are not intended to limit the scope of the appended claims. This disclosure is to be considered an exemplification of the principles of the invention and is not intended to limit the spirit and scope of the invention and/or claims of the embodiment illustrated.

Those skilled in the art will make modifications to the invention for particular applications of the invention.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

Having described this invention in connection with a number of embodiments, modification will now certainly suggest itself to those skilled in the art. The example embodiments herein are not intended to be limiting, various configurations and combinations of features are possible. As such, the invention is not limited to the disclosed embodiments, except as required by the appended claims.

What I claim is:

1. A zero impact head gear comprising:

a) an outer helmet comprising:
   (i) an outer shell comprising an energy absorbing material;
   (ii) an inner liner comprising an energy absorbing material; and
   (iii) a rigid shell between the outer shell and the inner liner;

b) an inner helmet comprising an energy absorbing material, the inner helmet being sized relative to the outer helmet so as to provide a gap between an outer surface of the inner helmet and an inner surface of the inner liner when worn by an individual;

c) a forward retaining stop and a rear retaining stop protruding from the inner liner;

d) a forward halo stop and an opposing rear halo stop each protruding from the inner helmet;

e) wherein the forward retaining stop and the forward halo stop are positioned so as to allow movement of a head of the individual within the outer helmet and capable of engaging each other to limit a forward displacement of the head of the individual out of the outer helmet;

f) wherein the rear retaining stop and the opposing rear halo stop are positioned so as to allow movement of the head of the individual within the outer helmet and capable of engaging each other to limit the forward displacement of the head of the individual out of the outer helmet;

g) wherein the forward and opposing rear halo stops are sized and configured such that forward and opposing rear halo stops do not touch the inner surface of the inner liner, and wherein the forward and rear retaining stops are sized so that they do not touch the outer surface of the inner helmet, so as to provide the gap surrounding the inner helmet between the outer surface of the inner helmet and the inner surface of the inner liner to allow free rotational movement of the inner helmet within the outer helmet, and wherein the rear retaining stop is contained between the forward halo stop and the opposing rear halo stop; and h) wherein the forward halo stop is an elongated bar or elongated bump that extends continuously from a first terminal end located on a left half of the inner helmet to a second terminal end located on a right half of the inner helmet.

2. The zero impact head gear of claim 1, further comprising a rigid cage.

3. The zero impact head gear of claim 2, wherein the rigid cage is affixed to the outer helmet.

4. The zero impact head gear of claim 2, wherein the rigid cage is formed integrally with the outer helmet.

5. The zero impact head gear of claim 2, wherein the rigid cage is formed into the outer helmet.

6. The zero impact head gear of claim 2, wherein outer helmet comprises the rigid cage.

7. The zero impact head gear of claim 1, further comprising shoulder pads and wherein the outer helmet is secured to the shoulder pads.

8. The zero impact head gear of claim 7, wherein the shoulder pads comprise a recess, and wherein a neck portion of the outer helmet is mountable within the recess of the shoulder pads.

9. The zero impact head gear of claim 7, further comprising a front locking bracket and a rear mount secured to shoulder pads, and wherein outer helmet comprises a rigid cage, and wherein the rigid cage is retained to the shoulder pads by the front locking bracket and the rear mount so as to secure the outer helmet to the shoulder pads.

10. The zero impact head gear of claim 9, further comprising side alignment brackets secured to the shoulder pads.

11. A zero impact head gear comprising:

a) an outer helmet comprising:
   (i) an outer shell comprising an energy absorbing material;
   (ii) an inner liner comprising an energy absorbing material; and
   (iii) a rigid shell between the outer shell and the inner liner;

b) an inner helmet comprising an energy absorbing material, the inner helmet being sized relative to the outer helmet so as to provide a gap between an outer surface of the inner helmet and an inner surface of the inner liner when worn by an individual;

c) a forward retaining stop and a rear retaining stop protruding from the inner liner;

d) a forward halo stop and a rear halo stop protruding from the inner helmet;

e) wherein the forward retaining stop and the forward halo stop are positioned so as to allow rotational movement of a head of the individual within the outer helmet and capable of engaging each other to limit a forward displacement of the head of the individual out of the outer helmet;

f) wherein the rear retaining stop and the rear halo stop are positioned so as to allow rotational movement of the head of the individual within the outer helmet and capable of engaging each other to limit the forward displacement of the head of the individual out of the outer helmet; and g) wherein the forward halo stop is located between the forward retaining stop and the rear retaining stop; and h) wherein the forward halo stop is an elongated bar or elongated bump that extends continuously from a first terminal end located on a left half of the inner helmet to a second terminal end located on a right half of the inner helmet.

12. The zero impact head gear of claim 11, further comprising a rigid cage.

13. The zero impact head gear of claim 12, wherein the rigid cage is affixed to the outer helmet.

14. The zero impact head gear of claim 12, wherein the rigid cage is formed integrally with the outer helmet.

15. The zero impact head gear of claim 12, wherein the rigid cage is formed into the outer helmet.

16. The zero impact head gear of claim 12, wherein outer helmet comprises the rigid cage.

17. The zero impact head gear of claim 11, further comprising shoulder pads and wherein the outer helmet is secured to the shoulder pads.

18. The zero impact head gear of claim 17, wherein the shoulder pads comprise a recess, and wherein a neck portion of the outer helmet is mountable within the recess of the shoulder pads.

19. The zero impact head gear of claim 17, further comprising a front locking bracket and a rear mount secured to shoulder pads, and wherein outer helmet comprises a rigid cage, and wherein the rigid cage is retained to the shoulder pads by the front locking bracket and the rear mount so as to secure the outer helmet to the shoulder pads.

20. The zero impact head gear of claim 19, further comprising side alignment brackets secured to the shoulder pads.

21. A zero impact head gear comprising:

a) an outer helmet comprising:

(i) an outer shell comprising an energy absorbing material;

(ii) an inner liner comprising an energy absorbing material; and (iii) a rigid shell between the outer shell and the inner liner;

b) an inner helmet comprising an energy absorbing material, the inner helmet being sized relative to the outer helmet so as to provide a gap between an outer surface of the inner helmet and an inner surface of the inner liner when worn by an individual;

c) a forward retaining stop and a rear retaining stop protruding from the inner liner;

d) an arcuate forward halo stop protruding arcuately along the inner helmet and an opposing arcuate rear halo stop protruding arcuately along the inner helmet, the rear retaining stop being disposed between the arcuate forward halo stop and the opposing arcuate rear halo stop; and e) wherein the rear retaining stop and the rear halo stop are positioned so as to allow rotational movement of the head of the individual within the outer helmet and capable of engaging each other to limit the forward displacement of the head of the individual out of the outer helmet; and g) wherein the arcuate forward retaining stop is an elongated bar or elongated bump that extends continuously from a first terminal end located on a left half of the inner helmet to a second terminal end located on a right half of the inner helmet.

22. The zero impact head gear of claim 21, further comprising shoulder pads and wherein the outer helmet is secured to the shoulder pads.

* * * * *